United States Patent [19]

Barclay et al.

[11] 4,141,803

[45] * Feb. 27, 1979

[54] METHOD AND COMPOSITION FOR ELECTROPLATING CHROMIUM AND ITS ALLOYS AND THE METHOD OF MANUFACTURE OF THE COMPOSITION

[75] Inventors: Donald J. Barclay, Olivers Battery; William M. Morgan, Chandlers Ford, both of England

[73] Assignee: International Business Machines Corporation, Armonk, N.Y.

[ * ] Notice: The portion of the term of this patent subsequent to Dec. 13, 1994, has been disclaimed.

[21] Appl. No.: 833,635

[22] Filed: Sep. 15, 1977

Related U.S. Application Data

[63] Continuation-in-part of Ser. No. 637,483.

[51] Int. Cl.[2] ..... C25D 3/06

[52] U.S. Cl. ..... 204/51; 423/366

[58] Field of Search ..... 204/43 R, 43 T, 51, 204/14 N; 423/366

[56] References Cited

U.S. PATENT DOCUMENTS 2,822,326 2/1958 Safranek ..... 204/43 R 4,054,494 10/1977 Gyllenspetz et al. ..... 204/43 T 4,062,737 12/1977 Barclay et al. ..... 204/43 R

FOREIGN PATENT DOCUMENTS 1258021 12/1971 United Kingdom ..... 204/51

OTHER PUBLICATIONS

D. J. Barclay et al., Inorganic Chemistry, vol. 9, No. 5, pp. 1024–1030, May 1970.

D. J. Levy et al., J. Electrochem. Soc., vol. 118, No. 10, pp. 1563–1570, Oct. 1971.

Paul Morisset et al., "Chromium Plating", p. 471, (1954).

D. J. Levy et al., Plating, pp. 1125–1131, Nov. 1970.

*Primary Examiner*—G. L. Kaplan

*Attorney, Agent, or Firm*—W. N. Hogg

[57] ABSTRACT

A plating solution, the making thereof and the use for chromium plating is disclosed. The solution is an equilibrated essentially aqueous solution of a hexavalent thiocyanatochromium III complex wherein the ratio of the total chromium III to the total thiocyanate is about 1:6. A preferred and improved method of making the solution from a hexathiocyanatochromium salt is also disclosed.

16 Claims, No Drawings

METHOD AND COMPOSITION FOR ELECTROPLATING CHROMIUM AND ITS ALLOYS AND THE METHOD OF MANUFACTURE OF THE COMPOSITION

RELATED APPLICATIONS

This is a continuation-in-part of application Ser. No. 637,483 filed Dec. 3, 1975, now U.S. Pat. No. 4,062,737, for Electrodeposition of Chromium and its Alloys. This is also related to application Ser. No. 833,634, filed Sept. 15, 1977, now abandoned, and entitled Method of and Solution for Electroplating Chromium and Chromium Alloys and Method of Making the Solution.

BACKGROUND OF THE INVENTION

Application Ser. No. 637,483 teaches a chromium, or chromium alloy electroplating solution, in which the source of chromium comprises an aqueous solution of a chromium (III) thiocyanate complex. Said application further describes a process of plating chromium, or a chromium containing alloy, which process comprises passing an electroplating current between an anode and a cathode in said electroplating solution.

In a preferred form the chromium (III) thiocyanate complex consists essentially of an aqueous solution of a chromium (III) aquo thiocyanate complex or mixture of complexes having the general formula:

$$((H_2O)_{6-n}Cr^{III}(NCS)_n)^{3-n};$$

where n = a postive integer 1 to 6 (Note: that the subscripts are always positive but the superscripts may be positive or negative). Complexes of this type are well known, see Inorganic Chemistry 9, 1024, (1970).

The plating from the solutions described in the above-mentioned application has many advantages over the conventional methods of plating chromium from the highly toxic chromic acid baths or from baths using toxic organic solvents. Most important of these is the removal of the serious health hazard present during plating and the fact that the effluent is easier and safer to dispose of. The present solution is less expensive, is more efficient electrically, and the useful life of the processing apparatus is much longer due to less corrosion. Significantly the deposited chromium is microcrack free and is capable of being bent without cracking. However, it has been found that the appearance of the chromium deposits at low current densities are strong functions of the ratio of the total concentration of chromium III to total thiocyanate in the plating solution. For example, at a total chromium III to total thiocyanate ratio of 1:2, while bright chromium is deposited at current densities in the range 20mA/cm$^2$ to 120mA/cm$^2$, this quality falls off rapidly below 20mA/cm$^2$; and in fact a black deposit is obtained at current densities less than about 15mA/cm$^2$. This can be deleterious when plating complex shapes on which there is a wide range of current densities. It is believed that reason for the black deposit is the partial deposition of chromium from $Cr(H_2O)_6^{3+}$ at low current densities. Previous attempts to plate chromium from this ion resulted in nonmetallic deposits.

SUMMARY OF THE INVENTION

The present invention provides a chromium or chromium alloy electroplating solution, in which the source of chromium comprises an aqueous solution of a chromium III thiocyanate complex or mixture of complexes, and where the ratio of total chromium III in the solution to the total thiocyanate is 1:6. As used herein the ratio of chromium III to thiocyanate in the solutions means the total chromium, both free ions and complexed ions, to the total thiocyanate, both free ions and complexed ions.

The present invention also provides a process of plating chromium, or a chromium containing alloy, comprising passing an electroplating current between an anode and a cathode in a plating solution comprising an aqueous solution of a chromium III thiocyanate complexes, where the ratio of total chromium III to the total thiocyanate is 1:6. This provides good plating at low current densities. This will allow good plating results with current densities even as low as 5mA/cm$^2$ and up to 320 mA/cm$^2$.

DESCRIPTION OF THE PREFERRED EMBODIMENTS

According to the present invention a chromium III thiocyanate complex or mixture of complexes preferably of the general formula $((H_2O)_{6-n}Cr^{III}(NCS)_n)^{3-n}$ wherein n is a positive integer from one to six is employed in aqueous solution. The solution is so formed and equilibrated that the ratio of the total chromium III (both free ions and complexes) to the total thiocyanate (both free ions and complexes) is 1:6. This is accomplished by providing thiocyanate in sufficiently large excess whereby the equilibrium of the equation:

$$Cr(H_2O)_6^{3+} + (NCS)^- \rightleftarrows Cr(H_2O)_{6-n}(NCS)_n$$

tends to the right so that the concentration of $Cr(H_2O)_6^{3+}$ is low and the deposition of black deposits is minimized. By this means the range of practical current densities can be increased to between 5mA/cm$^2$ to 120mA/cm$^2$.

The advantage of a 1:6 ratio of chromium III to thiocyanate is not only that it increases the practical range of current densities, but also that the ion $Cr(NCS)_6^{3-}$ is stable and is commercially available from hexathiocyanatochromium III salts, such as $K_3Cr(NCS)_6$; $Na_3Cr(NCS)_6$; or $(NH_4)_3Cr(NCS)_6$. By equilibrating this ion, for example at 80° C. for three hours, the required $Cr(H_2O)_{6-n}(NCS)_n$ species may be formed. It will be clear that the preparation of the aquo chromium III thiocyanate ions by this technique is significantly easier than by the method described in the above-mentioned patent application Ser. No. 637,483.

Another significant advantage of plating chromium from trivalent chromium thiocyanate electrolytes is the possibility of adding organic species such as wetting agents. This is not possible with chromic acid electrolytes since the organic material is spontaneously oxidized. It has been found that adding wetting agents such as TRITON-X (TRITON is a Trademark of Rhom and Haas Company) or FC-98 (a product of the 3M Corporation), to the aqueous chromium III thiocyanate plating solution improves the appearance of the deposited chromium and extends the maximum current density at which deposition can occur before gas streaming prevents plating. Hull cell tests have shown that with the addition of these wetting agents the range of current density for bright deposits can be increased to between 5mA/cm$^2$ to 170mA/cm$^2$.

It has also been found that the conductivity of the plating solution can be increased by adding salts such as sodium perchlorate ($NaClO_4$), sodium sulphate ($Na_2SO_4$) or potassium sulphate ($K_2SO_4$).

Increasing the total chromium concentration in the solution up to about 0.1M, while maintaining the 1:6 ratio of chromium to thiocyanate, improves the plating efficiency of the bath and increases the maximum current density at which bright deposition occurs to 320mA/cm$^2$.

Nickel or cobalt sulphate can be added to the solution for plating chromium/nickel or chromium/cobalt alloys, as described in the above-mentioned specification Ser. No. 637,483.

The above-mentioned specification Ser. No. 637,483 describes the use of an ion exchange membrane to separate the anolyte from the bulk plating solution. The purpose of this membrane is to prevent the fall of solution pH during plating. Apart from this pH change no deleterious anode reactions have been observed. A disadvantage associated with the use of the membrane is the higher voltage required to overcome its resistance to current flow and the resulting rise in bath temperature. Accordingly ion exchange membranes have not been used in the plating process described herein.

Using a normal ratio of solution volume to electrode surface area (no more than 100 cm$^2$ electrode area per liter of solution) and when plating parts with a normal bright chromium thickness (say 0.3 to 0.5$\mu$m), the pH change during a plating cycle is not sufficient to affect plating. The pH can be adjusted, periodically during use, by addition of small quantities of sodium hydroxide solution. Alternatively the pH can be maintained within the required limits by automatic additions of sodium hydroxide solution.

The invention will now be described with reference to the following examples:

EXAMPLE I

A 0.05M aqueous solution of aquo chromium III thiocyanate complex ions was prepared as described in said application Ser. No. 637,483, i.e., by heating sodium thiocyanate together with a chromium perchlorate solution. However, sufficient excess sodium thiocyanate was used to result in a ratio of chromium III to thiocyanate of 1:6. Sodium perchlorate was added to increase the conductivity of the solution. A wetting agent, TRITON-X was also added to the solution.

The composition of the plating solution comprised:

| | |
|---|---|
| Chromium III | 0.05M |
| Thiocyanate | 0.30M |
| Boric Acid | 50g/liter (saturation) |
| Sodium Perchlorate | 100g/liter |
| TRITON-X | 0.10ml/liter |

A brass plate was plated from the solution described above using a standard Hull cell under the following conditions:

| | |
|---|---|
| Anode | Platinized titanium mesh |
| Cathode | Brass Hull cell plate |
| pH | 2.6 |
| Temperature | 20° C |
| Total Current | 4A |
| Cell Voltage | 8.5V |
| Plating Time | 2 minutes |

The cathode was found to be plated with a bright chromium deposit from the 4mA/cm$^2$ to the 170mA/cm$^2$ positions on a Hull cell scale.

Below the 4mA/cm$^2$ level there were interference colors due to very thin chromium deposits followed by a bare brass area. Above the 170mA/cm$^2$ deposition had been prevented by excessive hydrogen gas streaming. The pH of the solution after plating was 1.80. Thus bright chromium of rich attractive color was obtained over the whole of the plating current density range and no black deposit was produced at low current densities.

EXAMPLE II

A solution was prepared as in Example I with 0.1M chromium (III).

The composition of the plating solution comprised:

| | |
|---|---|
| Chromium (III) | 0.1M |
| Thiocyanate | 0.6M |
| Boric Acid | 50g/liter (saturation) |
| Sodium Perchlorate | 100g/liter |
| TRITON-X | 0.1ml/liter |

A brass Hull cell cathode was plated from this solution in a standard 267mm Hull cell under the following conditions:

| | |
|---|---|
| Anode | Platinized titanium mesh |
| Cathode | Brass Hull cell plate |
| pH | 2.6 |
| Temperature | 20° C |
| Total Current | 5A |
| Cell Voltage | 11V |
| Plating Time | 2 minutes |

The cathode was found to be plated with a bright chromium deposit from the 10mA/cm$^2$ to the 320mA/cm$^2$ positions.

Below 10mA/cm$^2$ and above 320mA/cm$^2$ a band of interference colors faded out to bare brass. The deposit was slightly darker in color than deposits plated from 0.05M chromium solutions. The high current density limit was calculated from R. O. Hull's formula given in the book, "Nickel and Chromium Plating", (page 23) by Dennis & Such, published by Newnes-Butterworths.

Examples III to VI describe alternative methods of preparing a solution containing $Cr(NCS)_6^{3-}$ ions.

EXAMPLE III

A 0.05M aqueous solution of sodium hexathiocyanatochromium (III) ($Na_3Cr(NCS)_6$) was saturated with boric acid ($H_3BO_3$). The solution was then heated at 80° C. for three hours. The solution was then cooled and 100g/liter $NaClO_4$ was added to increase the conductivity of the solution. The wetting agent TRITON-X was added.

The composition of the plating solution comprised:

| | |
|---|---|
| Chromium (III) | 0.05M |
| Thiocyanate | 0.30M |
| Boric Acid | 50g/liter (saturation) |
| Sodium Perchlorate | 100g/liter |
| TRITON-X | 0.1ml/liter |

EXAMPLE IV

A 0.05M aqueous solution of sodium hexathiocyanatochromium (III) ($Na_3Cr(NCS)_6$) was saturated with boric acid. The solution was then reduced electrochemically on a mercury electrode at a potential of −1000mV vs SCE to produce a solution of chromium II thiocyanate complexes. This solution was was reoxidized at −300mV vs SCE to produce a mixture of aquo chromium (III) thiocyanate complexes. (See Inorganic Chemistry 9, 1028, 1970.) 100g/liter sodium perchlorate was added to increase the conductivity of the solution. A wetting agent TRITON-X was also added.

EXAMPLE V

A 0.05M aqueous solution of potassium hexathiocyanatochromium (III) ($K_3Cr(NCS)_6$) was saturated with boric acid. The solution was then heated at 80° C. for three hours. The solution was then cooled and 100g/liter sodium sulphate was added to increase the conductivity of the solution. The wetting agent TRITON-X was added.

The composition of the bath comprised:

| | |
|---|---|
| Chromium (III) | 0.05M |
| Thiocyanate | 0.30M |
| Boric Acid | 50g/liter (saturation) |
| Sodium Sulphate | 100g/liter |
| TRITON-X | 0.1ml/liter |

A convenient way of providing the electrolytes is a concentrate of an aqueous solution of the chromium (III) thiocyanate complex having the 1:6 chromium to thiocyanate ratio, which can be diluted to give the desired concentration of the various ions.

While the invention has been particularly shown and described with reference to preferred embodiments thereof, it will be understood by those skilled in the art that various changes in form and details may be made therein without departing from the spirit and scope of the invention.

What is claimed is:

1. A method of forming a plating solution comprising the steps of equilibrating an aqueous solution of a salt selected from the group $Na_3Cr(NCS)_6$ and $K_3Cr(NCS)_6$ and adding boric acid in saturation amount.

2. The invention as defined, in claim 1, wherein the salt is $Na_3Cr(NCS)_6$, and wherein the solution is electrochemically reduced and thereafter reoxidized.

3. The invention as defined in claim 2, wherein the salt is prepared electrochemically at a mercury electrode.

4. A method of electroplating chromium comprising the steps of providing an essentially aqueous solution of a chromium III thiocyanate complex in effective concentration for electroplating of chromium, the ratio of the total chromium III to the total thiocyanate being about 1:6, and passing an electric current between an anode and a cathode in said solution.

5. The invention as defined in claim 4 wherein the aqueous solution of the chromium III thiocyanato complex is an equilibrium solution of a hexathiocyanatochromium III salt.

6. A method as claimed in claim 5, in which the hexathiocyanatochromium (III) salt is selected from the group $Na_3Cr(NCS)_6$ and $K_3Cr(NCS)_6$.

7. The method as claimed in claim 6, wherein the solution is saturated with boric acid.

8. The invention as defined in claim 4, further characterized by said solution being approximately a 0.05M solution.

9. A method as claimed in claim 4, further characterized by an effective amount of a salt to increase the electrical conductivity of said solution.

10. A method as claimed in claim 9, in which the salt is selected from the group sodium perchlorate, sodium sulphate, and potassium sulphate.

11. A method as claimed in claim 4, further characterized by an effective amount of a wetting agent in said solution to lower the surface tension.

12. An electroplating solution having a source of chromium comprising an essentially aqueous solution of a chromium III thiocyanate complex, the ratio of total chromium III to total thiocyanate being 1:6, the concentration of the chromium being at least 0.05 M and the thiocyanate being at least 0.30 M, and a salt in effective amount to increase electrical conductivity.

13. A solution as claimed in claim 12, in which the salt is selected from the group sodium perchlorate, sodium sulphate, and potassium sulphate.

14. An electroplating solution having a source of chromium comprising an essentially aqueous solution of a chromium III thiocyanate complex, the ratio of total chromium III to total thiocyanate being 1:6, the concentration of the chromium being at least 0.05 M and of the thiocyanate being at least 0.30 M, and an effective amount of a wetting agent to lower the surface tension.

15. An electroplating solution having a source of chromium comprising an aqueous solution at equilibrium of a chromium III thiocyanate complex selected from the salts $Na_3Cr(NCS)_6$ and $K_3Cr(NCS)_6$, the concentration of the chromium being at least 0.05 M and of the thiocyanate being at least 0.30 M, the ratio of total chromium III to total thiocyanate being 1:6, and boric acid in saturation amount.

16. A method of forming a plating solution comprising the steps of equilibrating an aqueous solution of a salt selected from the group $Na_3Cr(NCS)_6$ and $K_3CR(NCS)_6$ by heating the solution to about 80° C. for about three hours.

* * * * *